US011261382B2

(12) United States Patent
Masten, Jr.

(10) Patent No.: US 11,261,382 B2
(45) **Date of Patent: *Mar. 1, 2022**

(54) NON-COMBUSTION HYDROCARBON GASIFICATION

(71) Applicant: James William Masten, Jr., Everett, WA (US)

(72) Inventor: James William Masten, Jr., Everett, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/923,904

(22) Filed: Jul. 8, 2020

(65) Prior Publication Data

US 2020/0339885 A1 Oct. 29, 2020

Related U.S. Application Data

(63) Continuation of application No. 15/671,730, filed on Aug. 8, 2017, now Pat. No. 10,717,933.

(60) Provisional application No. 62/372,540, filed on Aug. 9, 2016.

(51) Int. Cl.

| | |
|---|---|
| ***C10B 53/07*** | (2006.01) |
| ***C10B 19/00*** | (2006.01) |
| ***C10B 41/00*** | (2006.01) |
| ***C10B 47/32*** | (2006.01) |
| ***C10B 53/00*** | (2006.01) |

(52) U.S. Cl.

CPC ..... *C10B 53/07* (2013.01); *C10B 19/00* (2013.01); *C10B 41/00* (2013.01); *C10B 47/32* (2013.01); *C10B 53/00* (2013.01)

(58) Field of Classification Search

USPC ..... 422/184–186; 201/35, 41; 202/96, 202/222–225; 219/553

See application file for complete search history.

(56) References Cited

U.S. PATENT DOCUMENTS

| | | | | |
|---|---|---|---|---|
| 10,717,933 | B2 * | 7/2020 | Masten, Jr. | C10B 53/07 |
| 10,718,527 | B2 * | 7/2020 | Masten, Jr. | H05B 3/748 |
| 10,738,368 | B2 * | 8/2020 | Masten, Jr. | C21D 11/00 |
| 11,045,755 | B2 * | 6/2021 | Masten, Jr. | B01D 35/185 |
| 2011/0150035 | A1 * | 6/2011 | Hanson | G01K 11/12 374/161 |
| 2018/0142174 | A1 * | 5/2018 | Grainger | C10B 53/02 |

* cited by examiner

*Primary Examiner* — Nina Bhat

(57) ABSTRACT

A method for non-combustive gasification of a hydrocarbon material includes introducing a mass of hydrocarbon material into a chamber, wherein a transmissive wall of the chamber has a pass band in the infrared frequency spectrum, removing air from the chamber; heating the hydrocarbon material within the chamber by radiating, from an infrared emitter, infrared radiation at a frequency corresponding to the pass band to convert at least one component of the hydrocarbon material to a gas, and turning the hydrocarbon material within the chamber to expose inner material to the infrared radiation.

19 Claims, 10 Drawing Sheets

NON-COMBUSTION HYDROCARBON GASIFICATION

CROSS REFERENCE TO RELATED APPLICATIONS

The present application is a continuation of U.S. patent application Ser. No. 15/671,730 filed Aug. 8, 2017, and issued as U.S. Pat. No. 10,717,933 on Jul. 21, 2020, entitled "NON-COMBUSTION HYDROCARBON GASIFICATION: AN OPTIMAL INFRARED RADIANT ENERGY THERMO-PHYSICAL TRANSFORMATION PROCESS," which claims the benefit of Provisional Application No. 62/372,540, filed Aug. 9, 2016, the disclosures of which are incorporated by reference herein in their entirety.

FIELD OF THE INVENTION

The Method and the Apparatus described herein have application in the transformation of waste hydrocarbons, contaminated soils and other wet (non-aqueous) or dry solids that may contain organic materials. Such materials may include sewage, petrochemicals (fuels, lubricants, paint, coatings, adhesives, etc), Municipal Solid Waste (MSW), Industrial Waste and metals processing. Any of these materials could be considered Hazardous Waste depending on conditions.

Additionally, the method and the apparatus can be applied to certain industrial transformation processes which might benefit from a highly efficient, zero-emissions thermal process applied at low pressures (i.e., a vacuum) which may include food processing and the processing of pharmaceuticals.

BACKGROUND OF THE INVENTION

Waste processing systems common in the world today are nearly universally single-event partial combustion systems. These systems may combine both heat and pressure but they are typically brute force processes that either transform the waste material through the heat of incineration or gasify by partial combustion in a controlled oxidation process, either of which may be applied at elevated pressures. Even pyrolysis systems typically are implemented as bulk single-step events.

Pyrolysis and similar traditional processes all involve pre-combustion processes and combustion during the execution of the process. As such, they all include the products of combustion that must be cleaned or managed. The processes themselves are termed "oxygen deprived," but that is only because the oxygen is actually used up in a combustion activity that is a part of the actual process, directly or indirectly.

Thermal energy is transferred to the feedstock in those traditional processes chiefly through convection and conduction. A very small percentage of the thermal energy is transferred through radiation because the processes usually involve combustion above or below the feed material, which is typically being heated by convective flow from the combustion. This means the "smoke" from the fire is used to heat the feed material to the point where light gases are driven out and "char" is broken down (to an extent).

In traditional systems, the gases formed are usually driven across metal catalysts that are heated by the process, typically to about 200° C. (~400° F.). The hot catalysts seed chemical reactions that convert the molecular structures to "richer" gas forms (usually simpler molecular structures) more desirable for their energy content. Unfortunately, these metal catalysts quit working at about the temperatures where more efficient molecular "cracking" starts to happen, about 400° C. (~750° F.).

By their physical and mechanical nature, these traditional processes are more "batch" than continuous. And they produce undesirable products as part of their fuel production and in the waste materials left behind. In the principal method disclosed in this patent, feedstock moves through a novel radiant energy process on a continuous basis. Systems analysis shows the method has application from small systems, transforming approximately 5 pounds of hydrocarbons per minute, to larger system transforming nearly 300 pounds of hydrocarbon feedstock per minute. Total capacity exceeding this rate can be achieved using multiple installations.

BRIEF SUMMARY OF THE INVENTION

The method presented here is not a typical batch process as employed in current state of the practice; instead it is a serialized, continuous flow transformation that uses escalating temperatures to optimally refine raw waste by separating and appropriately transforming various component materials of the waste stream to beneficial products. The system described here is the second stage of system comprising three serial processes that each extracts partial products from the waste stream and transforms the waste stream to optimally prepare it for the next process step.

The three processes can, in fact, be appropriately implemented as stand-alone individual, but complete, systems when the material stream is simple and the process ambition is well prescribed.

The three serialized processes are:

- the removal and treatment of water (U.S. patent application Ser. No. 15/648,008),
- the transformation of hydro-carbons and the processing of some mineral elements (the subject of this disclosure),
- the processing of the waste stream residual mineral solids (left to a future disclosure).

The three treatment processes each have a characteristic critical temperature which, by the Ideal Gas Law (pv=nRT), is linked to pressure. When waste processing is implemented as a single event, the pressure cannot be optimized for any particular process and is optimized for a combined or complex process.

This disclosure will present the method of using high-intensity infrared radiant energy to transform solid and liquid hydrocarbons to a SynGas and process some minerals on a continuous basis at a relatively low partial pressure (i.e., a vacuum). The method does not combust or oxidize any reactant to any level. Instead, tunable electrically powered radiant emitters are used to project high-intensity infrared energy into a chamber in which hydrocarbon materials have been delivered for processing.

Several apparatuses support the methods by providing means to monitor and control the feedstream, the thermal energy delivered, the integrated exposure to the thermal energy, the effective recycling of thermal energy, the transformation and effective delivery of the beneficial products.

Views 4A-1, 4A-2, 4A-3: each of these shows initial relative positions of the cranks 6 that produce up/down motion of the chamber, regardless of the relative rotational direction in which the stepper motors are driven.

Views 4B-1, 4B-2, 4B-3: each of these shows initial relative positions of cranks 6 that, when combined with opposing rotational direction by the stepper motors, will cause the chamber to rotate.

Views 4B-4, 4B-5, 4B-6: each of these shows initial relative positions of cranks 6 that, when combined with unison rotational direction by the stepper motors, will cause the chamber to rotate.

Figure 5:
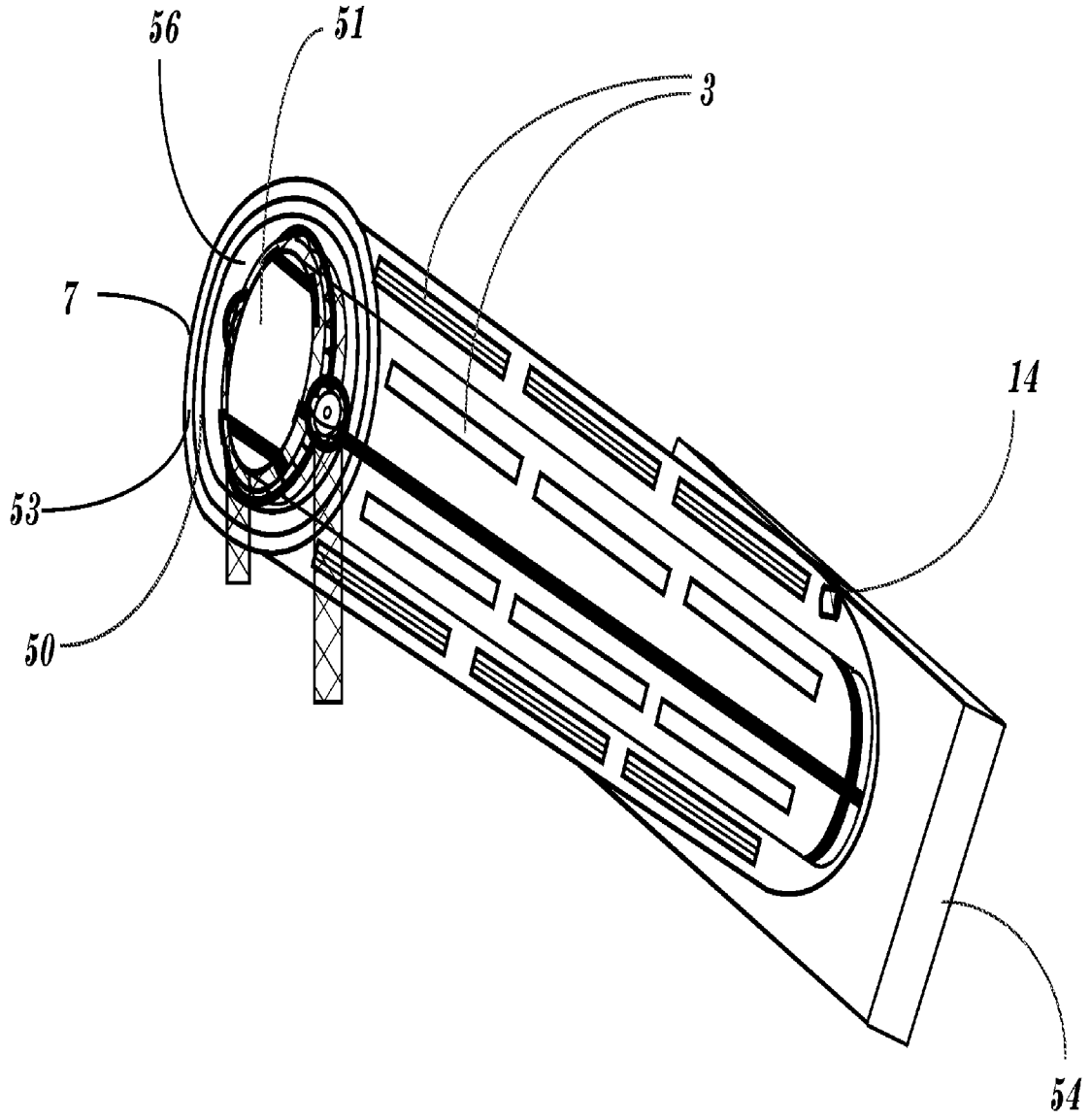

FIG. 5: Reveals the infrared radiant sources through the outer water-cooled pressure bulkhead.

Figure 6:
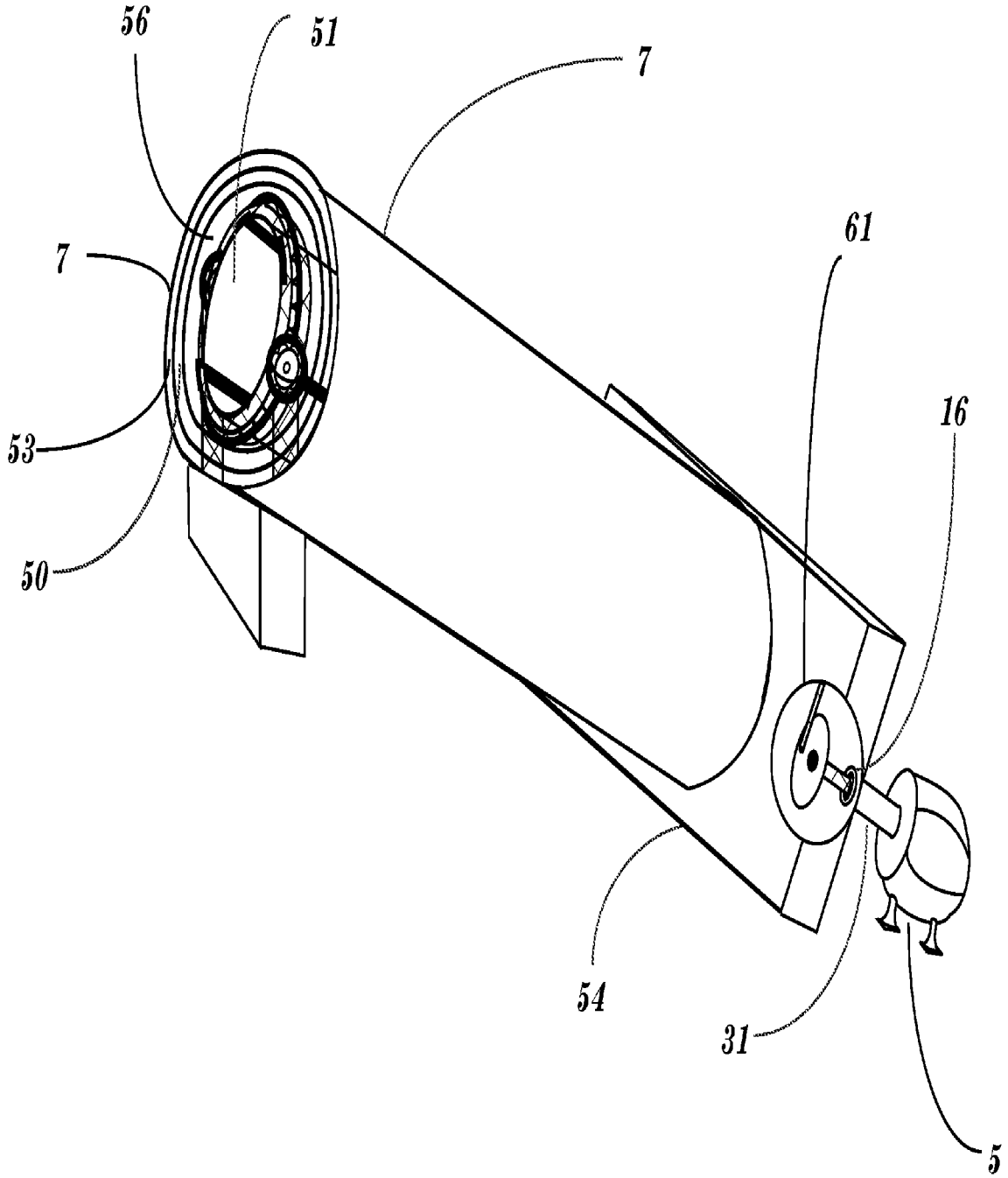

FIG. 6: Presents the outer water-cooled pressure bulkhead with the input vacuum valve removed to reveal the input end of the infrared transmissive chamber and at the opposite end reveals one of the stepper motors and the input shaft that passes through the pressure bulkhead.

Figure 7:
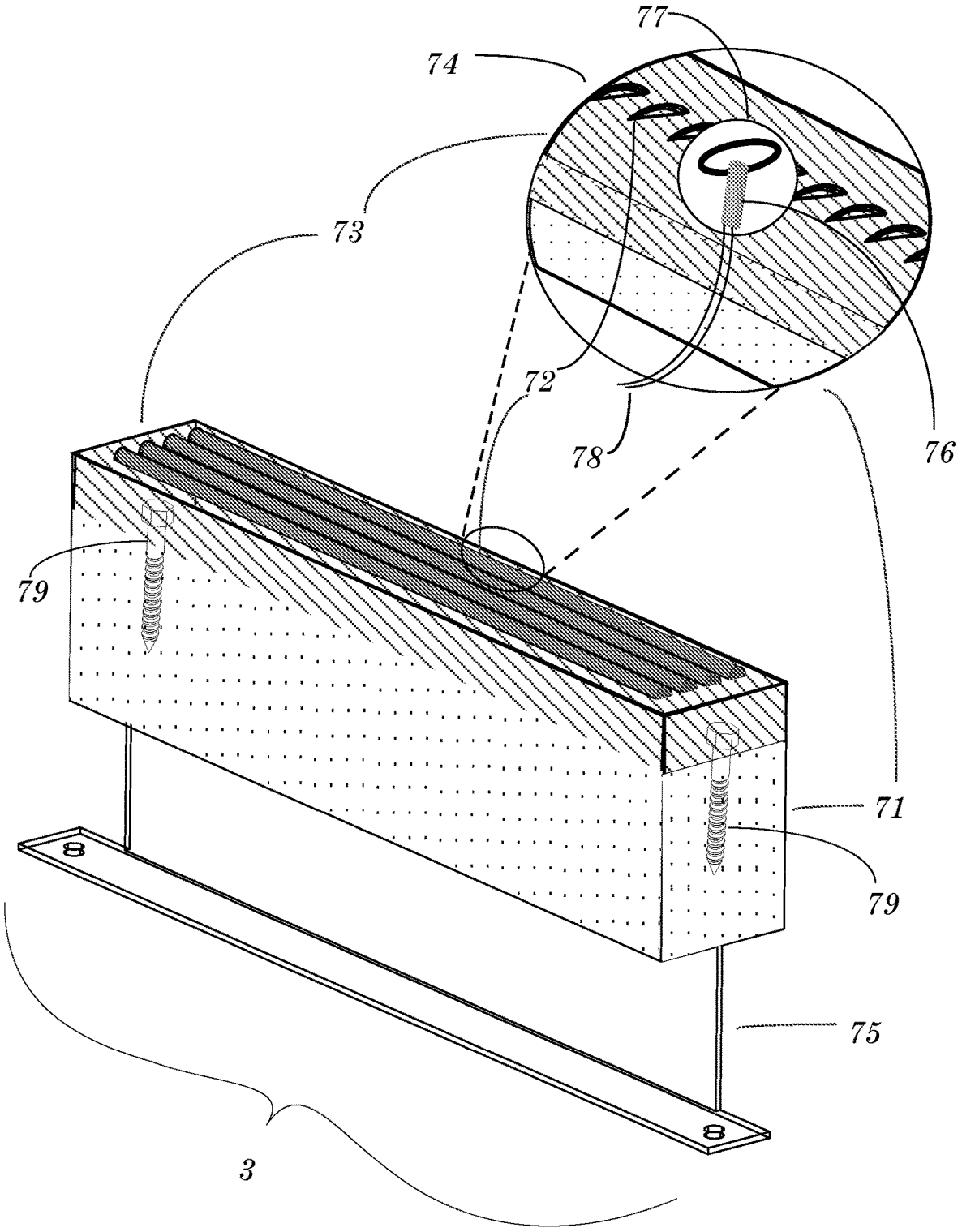

FIG. 7: Illustrates the infrared radiant element and the blowup of the emitter temperature sensor.

Figure 8:
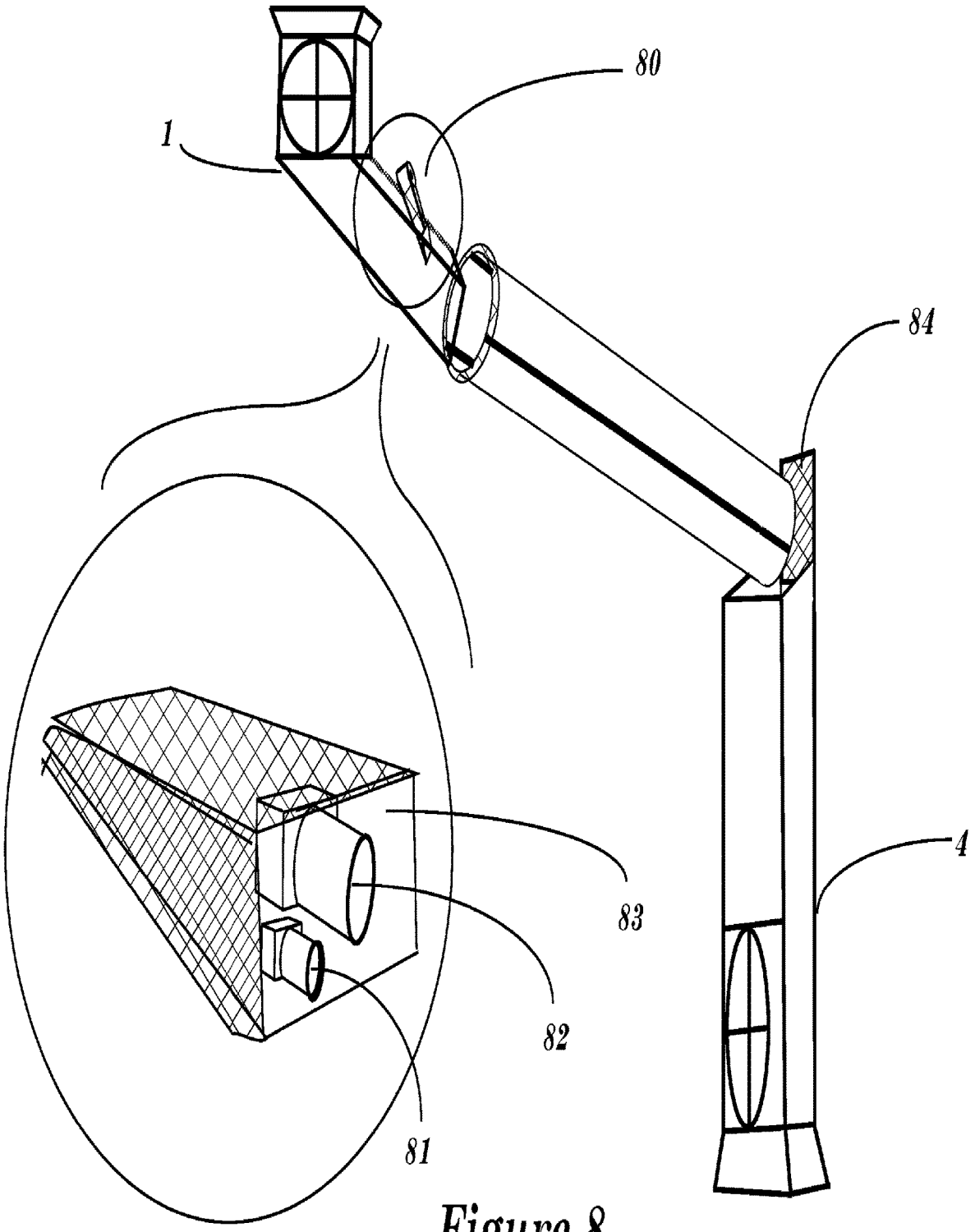

FIG. 8: Reveals the optical sensor system and relative location in the input channel duct.

Figure 9:
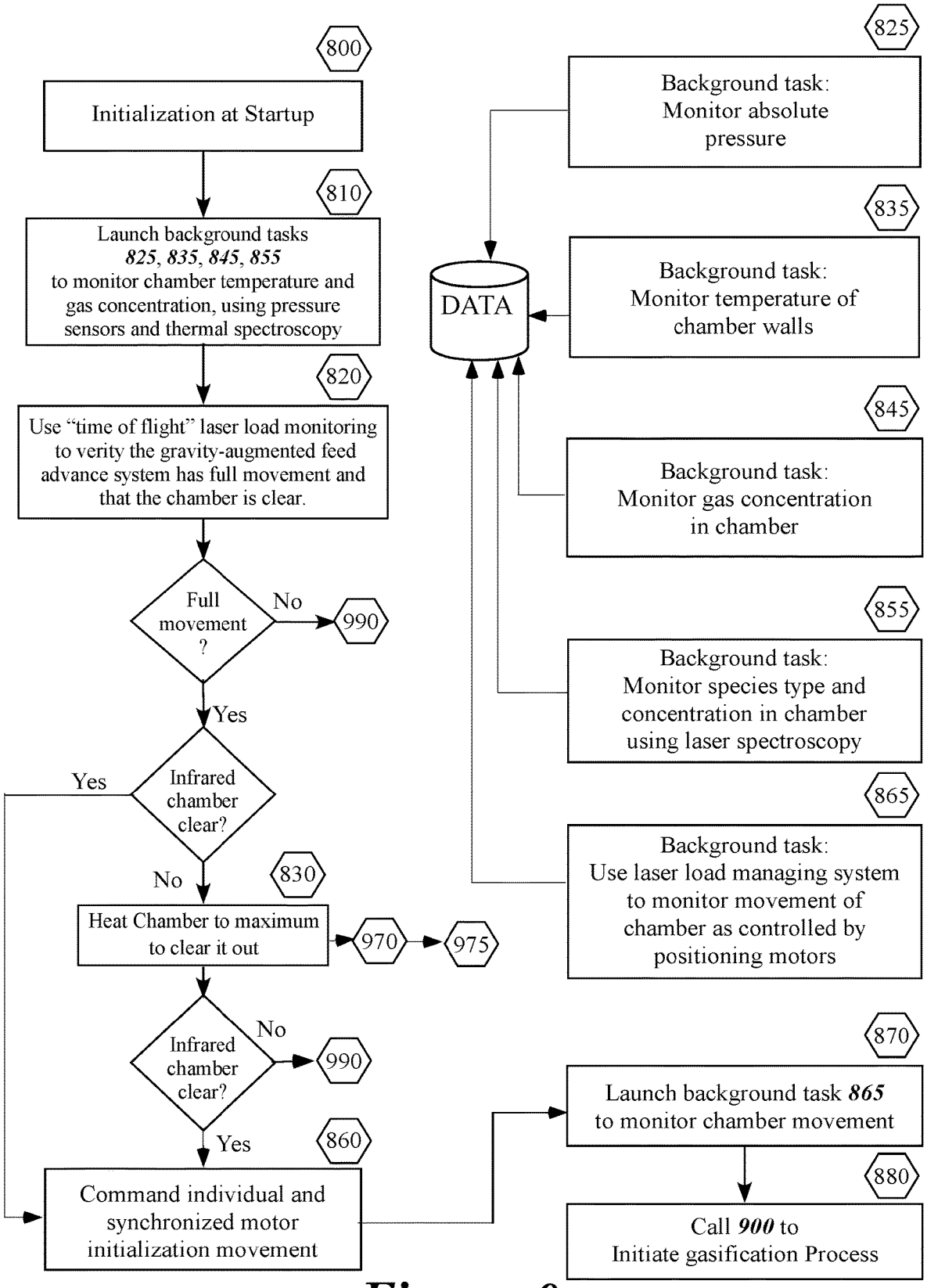

FIG. 9: Presents the background tasks and initial startup elements as process flow elements of the applied method.

Figure 10:
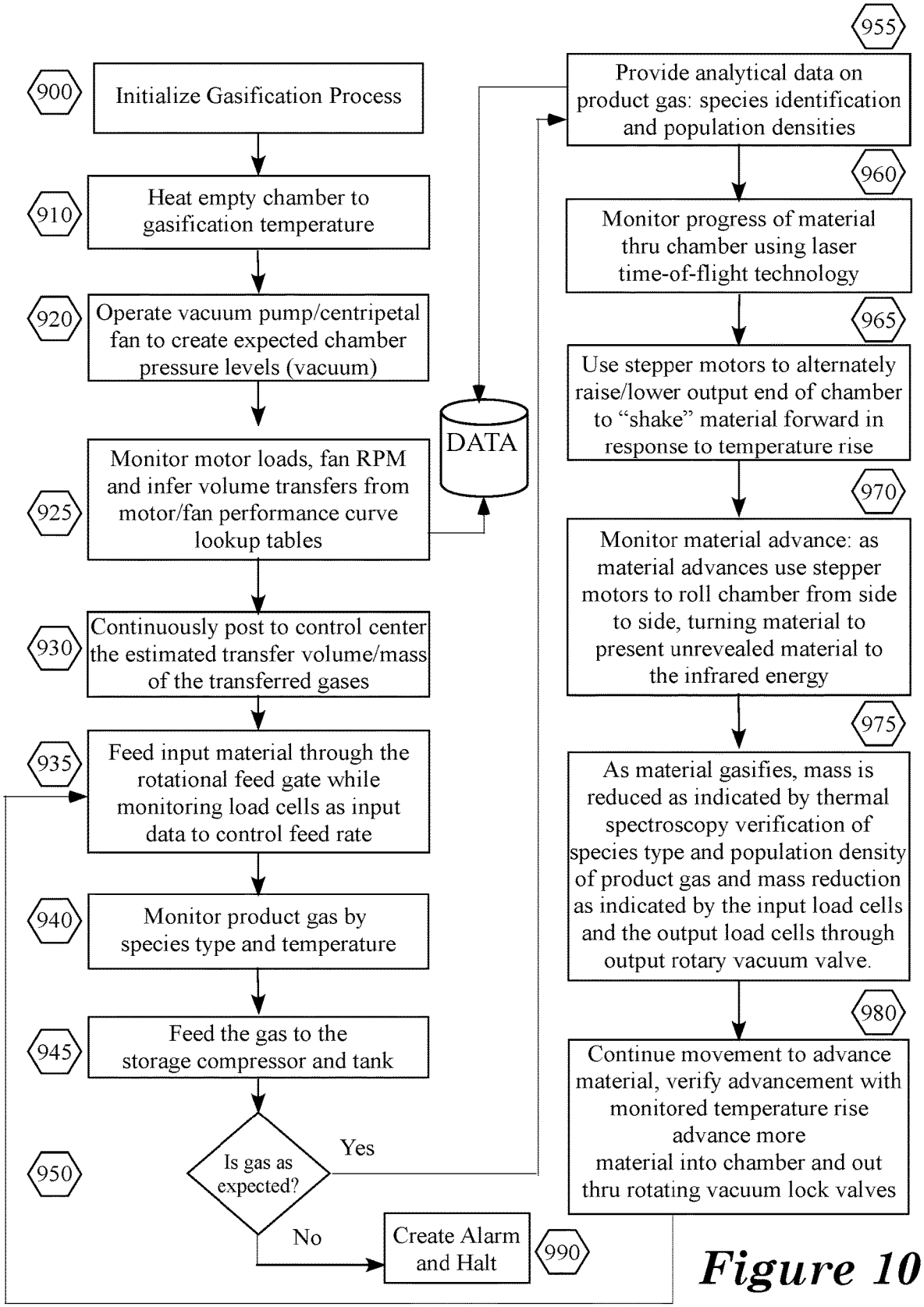

FIG. 10: Presents the main process flow of the method.

REFERENCE

Markings Description

1 Water-cooled input feedstream material chute with rotational vacuum material valve and optical system mount.

2 Infrared transmissive wall chamber.

3 High-intensity radiant source, some pictured with radiant side facing the view, some pictured with radiant sides facing away.

4 Water-cooled output feedstream material chute with rotational vacuum material valve.

5 Stepper motor (one of two) that implements the Gravity-Assisted Feedstream Advancement Subsystem (GAFAS). Designated as 5L (left) and 5R (right).

6 Transformational cranks that convert the rotational motion of the stepper motors to the vertical motion of each chamber positioning strut 9 (left and right). Part of Gravity-Assisted Feedstream Advancement Subsystem (GAFAS).

7 Pressure bulkhead, water cooled and lined with radiant energy-resistant refractory.

8 Input end of the radiant energy transmissive chamber rotational bearing mount.

9 Strut connecting the motion transformational cranks to the pivot struts on the infrared transmissive walls of the chamber. Part of Gravity-Assisted Feedstream Advancement Subsystem (GAFAS).

10 Heat exchanger that removes the heat from the gasified feedstream materials.

11 Compressor fan motor providing the energy to compress the produced gas and force it into the storage tank.

12 Compressor fan or impeller that compresses the gas into the storage tank.

13 Gas storage tank.

14 Pressure sensor.

15 Corona Discharge Ozone generator and free-radical injector.

16 Pressure seal around rotating shaft 31.

21 Load-carrying center shaft of the horizontal bearings that enable rotation around the horizontal diameter of the input end of the infrared transmissive chamber.

22 Horizontal ceramic ball bearing unit inner race and ball bearings (left and right).

23 Circumferential ceramic ball bearing unit outer race, ball bearings and mount for horizontal ball bearing unit 24.

24 Horizontal ceramic ball bearing unit outer race and mount attachment to the vertical strut.

25 Structural refractory seam component securing the transmissive wall sections together and retained by collars 26 and 30.

26 Circumferential collar providing structural support to the infrared transmissive walls of the chamber on the input end and providing a ceramic ball bearing inner race.

27 Front mass-supporting vertical machinable refractory strut

28 Individual load cell measuring mass and the force of gravity.

30 Circumferential collar providing structural support to the infrared transmissive walls of the chamber on the output end.

31 Connecting drive shaft between the stepper motor and the motion-transformational crank.

33 Ball bearing end link of the lower right hand strut to the pivot shaft of the motion transformational crank.

34 Output end of the radiant energy transmissive chamber.

35 Ball bearing end link of the lower left hand strut to the pivot shaft of the motion transformational crank.

36 Ball bearing end link of the upper right hand strut to the pivot shaft of the motion transformational crank.

37 Offset shaft bearing-mounted to the chamber and extending to the bearing-mounted strut.

38 Support shaft that is offset from the outer chamber walls and in parallel with the long axis of the chamber.

39 Offset shaft rotationally-bearing mounted at the horizontal diameter of the chamber.

50 Refractory-lined, water cooled inner chamber walls.

51 Highly infrared transmissive chamber interior wall.

53 Cast water-cooled inner chamber between the refractory lining and the outer pressure bulkhead maintaining the low pressure (i.e., vacuum) inside the infrared chamber.

54 Water-cooled outer, refractory-lined bulkhead pressure vessel housing the transformational crank and strut of the Gravity-Assisted Feedstream Advancement Subsystem (GAFAS).

56 Refractory lining that makes use of the Stefan-Boltzmann law to minimize reflected and conducted infrared energy protecting the water-cooled housing walls.

61 Cut away view of the pressure bulkhead revealing the seal 16 around rotating shaft 31 of the GAFAS motor 5.

71 Low-density ceramic insulator.

72 Partially exposed resistive infrared emitter.

73 Castable ceramic block providing the top layer of the infrared emitter and the castable ceramic cover for the majority of the emitter wire.

74 Magnification bubble showing the details of the infrared emitter radiating surface and a view to the interior and the embedded temperature measurement device.
75 Mounting bracket (various).
76 Embedded contact temperature measurement device.
77 Magnification bubble within a magnification bubble showing the positioning of the embedded contact temperature measurement device in contact with an emitting coil.
78 Temperature measurement device electrical leads.
79 Machined ceramic lag bolts or equivalent, machined from material with a similar thermal expansion coefficient to the castable ceramic.
80 Magnification bubble showing the details of the optical sensor suite.
81 High frequency (i.e., short wavelength) laser transmitter.
82 Broadband spectroscopy camera which observes energy by frequency or color.
83 Transmissive water-cooled window.
84 Non-reflective, energy-absorbing, cooled optical backdrop.

DETAILED DESCRIPTION OF THE INVENTION

The focus of this patent disclosure is the non-vented, zero emissions and highly efficient gasification of hydro-carbon materials, using temperatures between 500° F. (260° C.) and 2,200° F. (1,200° C.) and an adaptive process based on thermal spectroscopy to species-type the hydrocarbon present in the gasified material and the selection of appropriate partial pressure and temperature.

Details of methods and several apparatuses will be described which, when implemented as an integrated system, function adaptively to convert hydro-carbon materials to a Synthetic Gas. Minerals included in the feedstream as incidental constituents pass through the process without significant energy loss or problematic by-products.

The method employs real-time analytical processes that, among other functions, identify species types of the gases formed, guarding against contamination of the output products which might be caused by the vaporization of certain minerals.

The infrared gasification process is a unique, robust and efficient technique that is enabled by the methods and the apparatuses disclosed herein. The process is unconventional in that the input feedstream is non-aqueous and granular. These two feedstream features enable exposure to the infrared radiant energy through the unique infrared transmissive walled reaction-containment chamber and minimize the heating energy requirement to heat the hydrocarbon materials as well as any supporting structures.

The detailed description will present the several unique apparatuses and the methods that protect the infrared transmissive containment reaction chamber from atmospheric pressure, effect the advancement of feedstream materials through the chamber, uniquely provide the tunable radiant energy, and isolate the heating apparatus and the heated materials from conductive and convection heating loss mechanisms.

The infrared transmissive reaction chamber 2 is a tubular construction that accepts transmitted infrared energy of selected wavelengths through more than 90% of its circumference and 90% of its longitudinal axis. The mounting and support structure for the infrared transmissive tubular construction, taken as an integrated assembly, is the means by which the feedstream material moves through the system. This subsystem known as the Gravity-Assisted Feedstream Advancement Subsystem (GAFAS) is unique, as there is no mechanical system inside the Infrared Chamber, yet the GAFAS precisely moves the feedstream material through the Infrared Chamber in real time as required by the Method.

The transmissive chamber apparatus is constructed using machined refractory as a retaining collar 26 for the input end 8 of the chamber's transmissive walls. The transmissive walls are fitted together using refractory seam components 25, while output end retainer 30 completes the transmissive chamber structural system.

Front retaining collar 26 provides an inner bearing race around the outside of the structural retainer, enabling the rotation of the chamber about the longitudinal axis. The front outer bearing race 23 is supported by center shaft and inner race 21 of left and right horizontal ball bearing set 22 riding inside outer horizontal bearing race 24 attached to vertical strut 27, enabling the input end 8 of the chamber to pivot around its horizontal diameter such that the output end of the chamber 34 can rise and fall in elevation.

The output end of the chamber 34 is supported by a right 36 and left (not shown) bearing set mounted on offset shafts right 39 and left (not shown). The offset shafts are parallel to the input end horizontal diameter that runs through the input end bearings right 22 and left (not shown) and perpendicular to the long axis of the chamber. The output shafts are free to rotate in ball bearing mount right 37 and left (not shown). Ball bearing mount right 37 and left (not shown) are fixed to the structural ceramic collar 30 supporting and containing the infrared transmissive walls of the chamber.

The output end horizontal bearing set mounted on support shafts right 38 and left (not shown) are offset from the outer chamber walls on rotating offset shafts right 39 and left (not shown). The bearing sets right 36 and left (not shown) of the output end 34 of the chamber are components of struts 9 that have similar bearings right 33 and left 35 with similar geometric relationships mounted in the lower ends of the struts. Bearings right 33 and left 35 are set on pins that are parallel to the bearing support shafts right 38 and left (not shown) supporting the upper bearings right 36 and left (not shown) of the strut 9.

Figure 1:
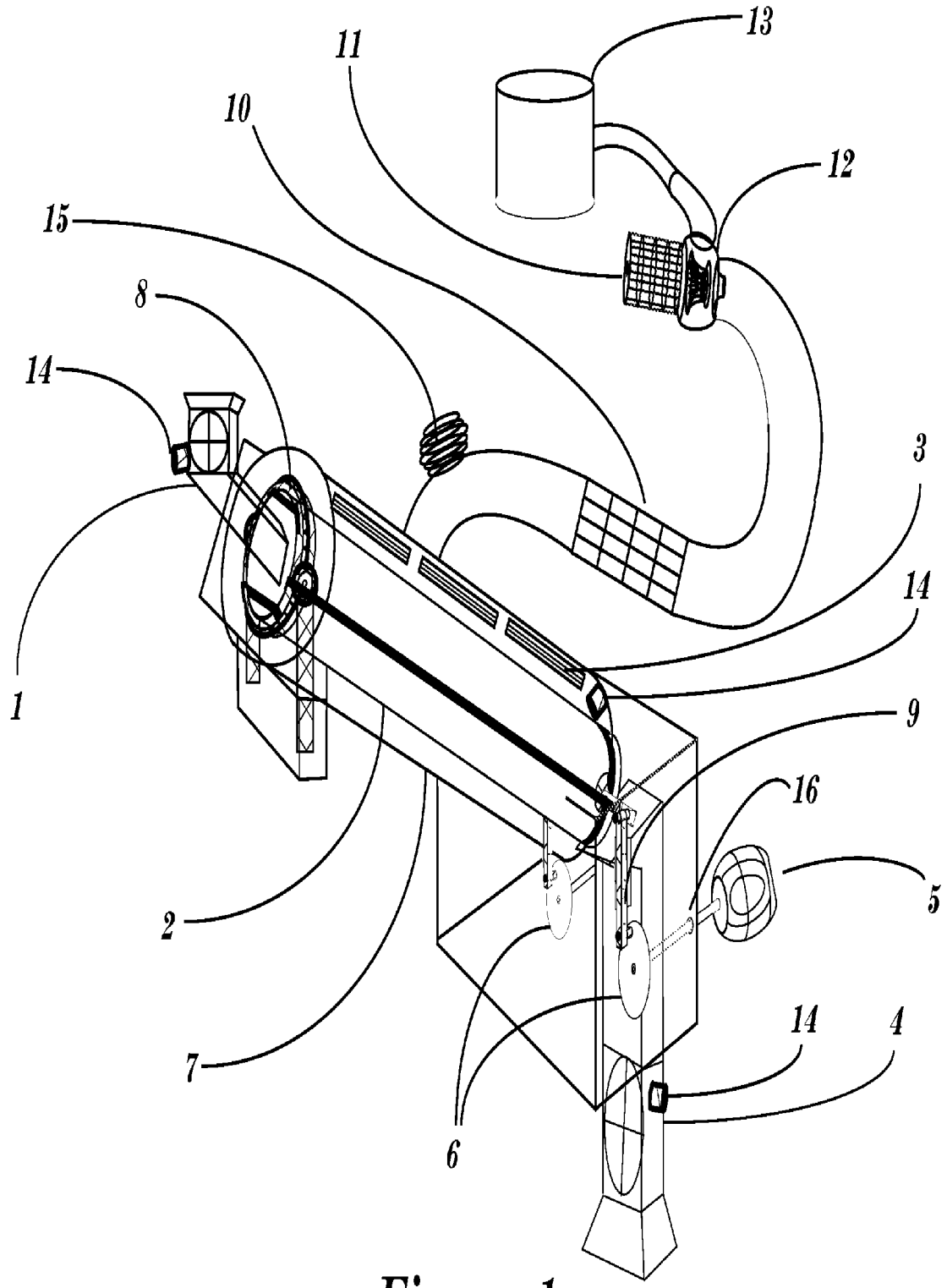
FIG. 1: A complete system architectural view of the infrared vacuum heating chamber and the automated feedstream handling systems.
Figure 2:
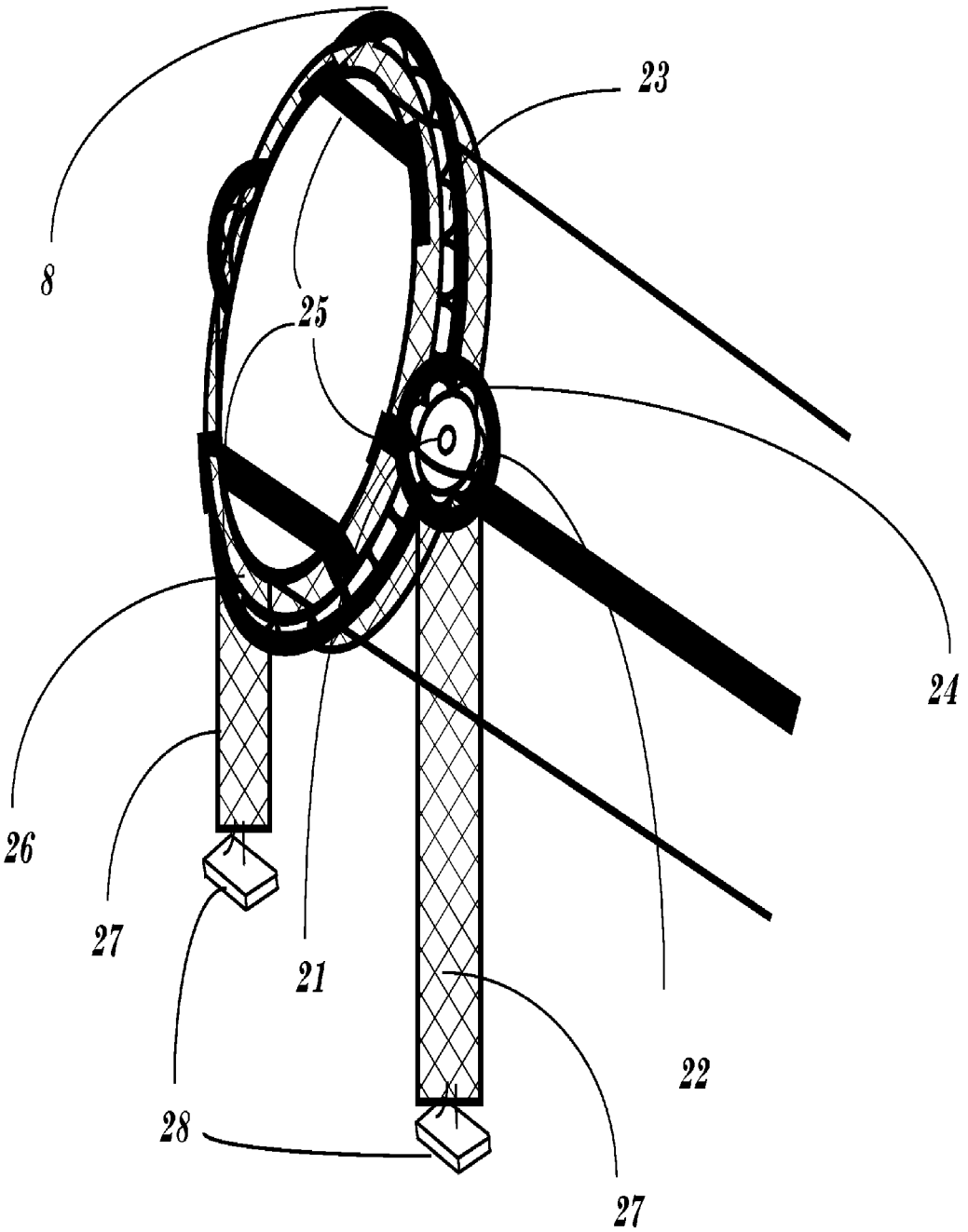
FIG. 2: Detailed presentation of the input end of the infrared heating chamber, mount and bearing system.
Figure 3:
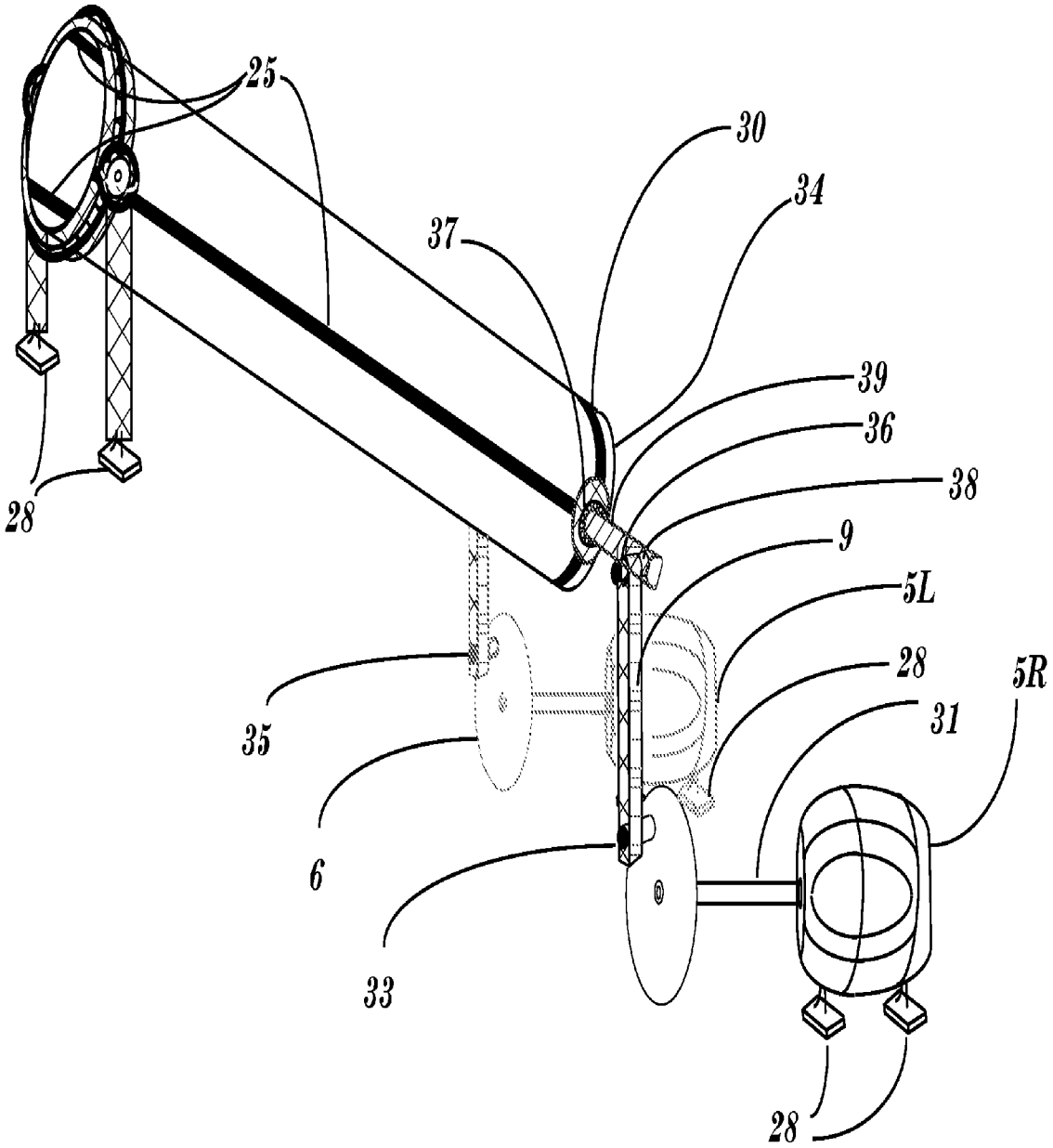
FIG. 3: Detailed presentation of the output end of the infrared heating chamber also revealing the gravity-assisted material handling system.
Figure 4:
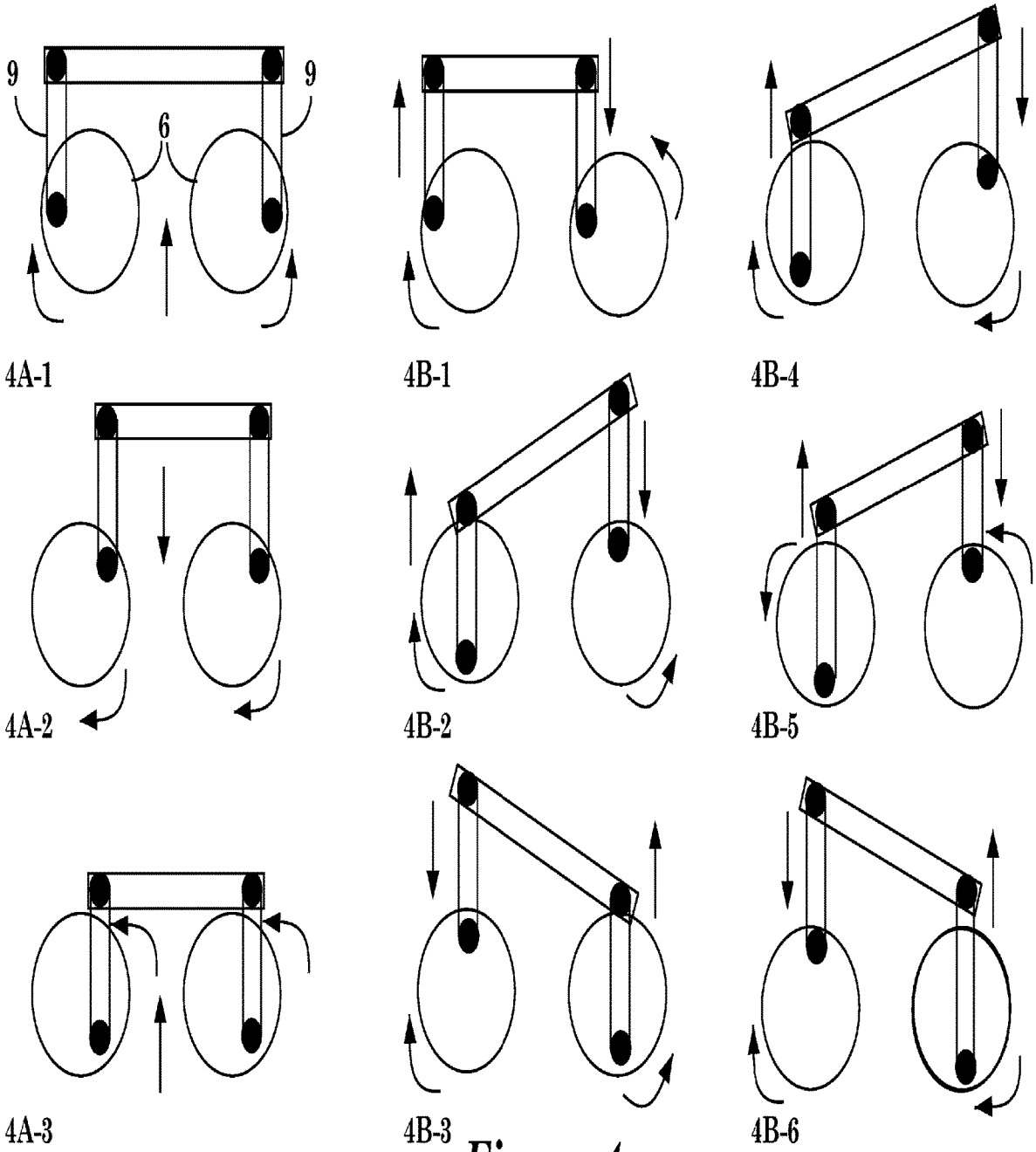
FIG. 4: Reveals the stepper motor actions to position the shaft mounted crank and strut which positions the output end of the infrared heating chamber. This figure contains multiple views, each of which relates the initial relative position of the crank 6 and stepper motor shaft rotational direction to dynamic motion of the output end of the infrared transmissive chamber.

The lower right 33 and left 35 bearings of the strut 9 are mounted on support shafts that are each mounted on a crank 6 attached to the shaft 31 of a stepper motor right 5R and left 5L such that the shafts 31 of the stepper motor right 5R and left 5L are parallel to the shafts of the strut 9 bearings. The two stepper motors right 5R and left 5L can be individually controlled to rotate their respective cranks 6 independently clockwise or counter-clockwise, individually or in unison to move incrementally. Depending on the relative starting positions of the cranks, the struts will raise or lower in unison or in opposition. Movement of the struts in unison will raise or lower the chamber. Movement of the struts in opposition will rotate the chamber approximately 45 degrees in either clockwise or counter-clockwise direction about the longitudinal axis. FIG. 4 shows various starting positions and rotational directions and their effects on the movement of the shafts.

It is the method's controlled use of the lifting, dropping and rotational motion of the chamber that, along with the force of gravity, moves the material through the chamber. The method controls the actual movement of the feedstream materials by monitoring the position of the materials using the optical suite 80 of a precision transmitter 81 and a broadband receiver or spectroscopy camera 82.

The feedstream material movement is precisely measured by the optical sensor suite 80 inserted in the roof of the intake channel 1 behind an optical broadband transparent thermal barrier 83. The optical sensor suite includes a high frequency laser 81 which operates outside of the pass band of the transmissive walls of the chamber, such that the chamber is a dark, low-noise environment for laser observations.

The laser transmitter 81 is used in a short pulse time-of-flight mode along with the broadband spectroscopy camera system 82 which records the reflected energy from the feedstream material in the chamber to create a three-dimensional image of the chamber interior 51. The chamber is "back-ended" by a unique non-emissive, cooled dissipating wall 84 which does not reflect stray thermal energy or reflect the transmitted laser energy to the spectroscopy camera system 82.

The accurate three dimensional map of material inside the chamber 51 enables the method to use the fixed focal length of the spectroscopy camera to precisely monitor the thermal emissions from the material inside the chamber 51. Using Wien's Displacement Law principals, the method can directly deduce the temperature of the solid materials inside the chamber 51. The broadband spectroscopy camera 82 can also detect the characteristic resonate absorption lines of the heated gaseous materials not angularly aligned with solid materials in the chamber. This spectroscopy measurement technique enables the species typing of the formerly solid materials now in vapor state.

Granular input feedstream material is admitted to the system through the rotational vacuum control valve 1, which is controlled by the method as applied by the embedded control computer (not shown). The feedstream material is decompressed (i.e., put under a vacuum) as monitored by the intake pressure sensor 14 as part of the intake rotary valve operational process. The material moves through the tubular chamber under GAFAS to the output rotational vacuum control valve 4 where again the recompression process is monitored by the output valve pressure sensor 14. The rotational vacuum control valves 1, 4 limit the admitted atmosphere as the input feedstream material is stripped of most of the atmosphere during the active intake process, while the mineral output is re-pressurized as part of the output rotational valve operational process.

The breakdown of some more complex hydrocarbon compounds will be aided by a Corona Discharge Ozone Generator 15 to inject free radicals or OH ions into the chamber which will elicit a "water reaction," whereby much of the remaining condensable gas is converted to a non-condensable Synthetic Gas (SynGas). Because this system operates in a vacuum and the SynGas product is not diluted with Nitrogen from the air, the SynGas has approximately the same energy density as Natural Gas.

The hydrocarbon gases formed by heating the hydrocarbon materials flow out of the lower end of the tube 34. In the evacuated environment, the hydrocarbon gases will flow downward as they have no heavy gases to push them up. A vacuum pump pulls the heated gases through a heat exchanger 10 arranged as a fire tube boiler (cross flow steam not shown). Steam from the boiler is used to drive a turbine generator (not shown). The cooled gas is forced into a pressurized storage tank 13 by inline pump 12 driven by motor 11. The compressed gases have value as various products.

The infrared radiators 3 of the system supply high-temperature radiant energy to the granular material as it is advanced by the GAFAS through the chamber to the rotary exit vacuum valve 4. The tunable infrared radiators 3 are uniquely constructed of coiled Ni-Chrome (or equivalent stable resistance vs. temperature material) wire 72 that has been set in a ceramic matrix or putty 73 along with an in situ temperature measurement sensor 76. Only 30 to 40% of each coil sits outside of the ceramic. But this construct 74 allows the wire to be heated above its plastic deformation temperature of about 500° F. (~260° C.) to a sustained operating temperature of more than 2,200° F. (1,200° C.).

The ceramic is poured into a mold that sits on top of a thick (>than 3") low-density fibrous ceramic refractory thermal insulator 71. Unlike existing emitters that use metal retention devices to secure the castable ceramic to the low-density ceramic insulation, which have a propensity for delamination because of the incompatibility of the coefficients of expansion, this embodiment uses pin or screw type retainer(s) 79 constructed from a machinable refractory with a coefficient of expansion which is compatible with the castable ceramic. There is a metal (aluminum) backing 75, but the edges near the radiant energy face of the emitter are refractory coated to form a significant thermal barrier.

Additionally, a temperature sensor 76 in a protective sheath of Iconel or Stainless Steel is embedded in the castable ceramic such that it is in contact with an embedded near center coil 77 making contact at the maximum depth from the surface of the ceramic. The temperature sensor leads 78 are brought out the back of the emitter and routed to the data collection system.

This construction restricts the emission of the radiant energy to a half cylinder near-Lambertian surface which concentrates the power of the emissions within 45° of normal to the long axis of the emitter for most of the emitter length.

The physical implementation of the coil embedment significantly extends the temperature range (i.e., wavelength) of the emitter and the embedded temperature sensor enables a capability for variable but precisely controlled radiant energy output. This capability contributes to the optimum "tunability" of the radiant emitter and enables the reliable method of projecting Infrared Radiant Energy through the pass band of the infrared transmissive walls of the chamber. The effective "tunability" of the radiant emitters spans a temperature range from less than 500° F. (260° C.) to more than 2,200° F. (1,200° C.) and can be controlled to an accuracy of less than 2° C.

The radiant elements are mounted behind the pressure vessel 7 and protrude through the inner refractory lined walls 56. The water cooling cavity 53 circulates water to remove heat from the inner wall 50 behind the refractory lining 56 of the interior walls of the chamber housing. The heat is collected to a thermal energy storage unit (not shown) for use in a preprocessing system (not shown) that removes water from the feedstream materials. The cooling provided to the pressure bulkhead enables the efficient and inexpensive sealing of the infrared transmissive chamber from the atmosphere. The inner walls 50 are protected from the radiant energy by the extensive use of a machinable refractory 56 to provide a thermal barrier and limit the penetration of infrared energy.

The water-cooled housing 53 and the thermal shielding 56 enable the pressure bulkhead orifices including the input and output rotary vacuum valves 1, 4 and the GAFAS drive shaft 31 penetration of the pressure bulkhead 16 to be sealed using high temperature low friction synthetic O-ring and lip seal technologies as shown in cut-away 61.

The pressure bulkhead 7 around the chamber is structurally connected to the GAFAS-encompassing bulkhead 54. The continuously evacuated space protected by the extended pressure bulkhead structure is monitored by the pressure sensor 14 located near the adjoining interface between pressure bulkhead 7 and pressure bulkhead 54. The low absolute pressure maintained practically eliminates all convection heating inside refractory lined housing 56. The interior of the chamber surrounding the infrared transmissive tube includes an extremely effective thermal barrier of more than 2 cm of extremely low thermal conductivity ceramic materials 56, which limits the radiant energy losses into water-cooled 53 inner walls 50 of the pressure bulkheads. Thermal energy transport inside the chamber 51 is almost completely radiant.

The radiant energy shielding 56 and the water cooling 53 enable bulkhead-mounting 7 of the load cells 28 supporting interior loads of the front vertical supports 27 while the strut components 9 and crank assemblies 6 of the GAFAS system at the rear of the chamber are supported by the motors outside the chamber using load cell 28 motor mounts.

The infrared transmissive tube has a near-zero coefficient of expansion. This is matched by the very low thermal conductivity ceramic materials used as the refractory lining of the chamber 56 to provide an effective shield to the radiant energy and the support structures that directly shape the tube 8, 25, 26, 30.

These apparatuses described in detail herein, when operated in a unique methodical way, present a new capability of highly efficient infrared gasification of hydrocarbon materials. The apparatus themselves are unique and present new capabilities: when operated as per the prescribed methods, the resulting integration is much more than the sum of the individual component technologies. The systematic operation of the apparatuses as per the methods disclosed herein presents a new capability for the clean, non-polluting, non-vented transformational conversion of waste materials to clean energetic resources.

A Structural Presentation of the Method

In a notional implementation of the Method presented in this disclosure and diagrammed in FIGS. 9 and 10, initialization 800, starts by calling process 810 to instantiate several background tasks 825, 835, 845, 855 that provide the real-time situational data flow required to control the adaptive process for an unknown feedstream that must be characterized during operation.

The method then causes the system to evaluate 820 the active condition of the infrared processing chamber 2 in anticipation of starting up the feedstream input activity. The chamber must be empty and the gravity-assisted advancement system must be functioning 5, 6, 9 to accurately coordinate the reported positions of the chamber in front of the laser 81. The software-controlled laser 81 operates at a high frequency where such wavelengths cannot pass through the walls of the chamber 2 and is used in a pulse time-of-flight mode to check the chamber passageway.

The gravity-assisted material advancement system 5, 6, 9 can move the chamber 2 around and present a majority of the interior chamber passageway 51 and walls to the laser's 81 transmitted pulse which is reflected by any material in the chamber for examination by the spectroscopy camera 82. If the chamber 2 is clear, then the reflections of the laser 81 from the walls will map out the three-dimensional cavity of the interior walls in the range-imagery map created by the spectroscopy camera 82 as resolved by the reported positions of the chamber by the gravity-assisted material advancement system 5, 6, 9.

If the chamber 2 is not clear, the method calls process 830 to heat the chamber to maximum, then calls process 970 and 975 to monitor the residual material and the gases generated. The method returns to process 830 to verify the chamber is clear. If the chamber 2 is still not clear, the method calls process 990 to create an alarm and halt the process until this situation is addressed by manual inspection.

If the chamber 2 is clear, then the method puts the GAFAS 5, 6, 9 into a background task of providing coordinating position data sufficient to manage real-time operation. The method then instantiates the continuous gasification process 900.

The gasification process starts by heating the chamber to gasification temperatures 910 by controlled current application to the radiant emitters 3, then preparing the chamber 2 by initializing the vacuum pump motor 11 and centripetal fan 12 to evacuate the chamber 2. The method 925 relies on the interpretation by look-up table of the motor 11 fan 12 current draw and RPM performance curves, respectively, to infer transfer volumes relative to measured pressures from the pressure sensors 14 inside the pressure bulkhead 7.

Process 935 advances the feedstream materials through the input rotary vacuum valve 1 into the chamber 2 where the high-intensity infrared emitters begin to transform the hydrocarbons to a gas. This gas is validated by the species-typing spectroscopy imaging camera 82 to be-free of any of several detectable minerals. The approved gas products are pushed by the fan 12 into a bulk storage holding tank 13. If undesirable minerals are detected in the gas flow 950, the process is halted with an alarm 990 and a separate mechanical activity may sequester the contaminated gas.

Acceptable gas flow maintains the method in operation to adapt the energy applied to the feedstream by monitoring the progress of the feedstream material through the chamber 2. The method 960 tracks the material through the chamber 2 using the measured distance provided by the pulse mode "time-of-flight" laser system 81, 82 and continuing advancement in response to the heating rate of the advancing materials 965.

The GAFAS 5, 6, 9 performs the additional function of adjusting the feedstream to reveal the feedstream material 970 that may be shielded from the infrared radiant energy by rolling the chamber to roll the feedstream material across the chamber 2 floor as the material advances through the chamber 2.

The method verifies the sufficient heating and advancement rates through the chamber by computing the expected gas volumes from the motor loads and fan RPM 925, computing the mass transformation 975 by directly monitoring the input and output load cells 28 and verifying via spectroscopy camera 82 the detected species type of the product gas by transformation rate of the species from a lookup table.

The method 980 continues as long as there are consistent feedstream materials coming though the input rotary vacuum lock valve 1, exiting rotary valve lock 4 while the monitored gas species are acceptable and the temperature profiles are maintained. The main method process loop reaches back to input more feedstream material and manage its progress through the chamber 935.

The invention claimed is:

1. A method for non-combustive gasification of a hydrocarbon material, the method comprising:

introducing a mass of hydrocarbon material into a chamber, wherein a transmissive wall of the chamber has a pass band in the infrared frequency spectrum;

removing air from the chamber; heating the hydrocarbon material within the chamber by radiating, from an infrared emitter, infrared radiation at a frequency corresponding to the pass band to convert at least one component of the hydrocarbon material to a gas; and turning the hydrocarbon material within the chamber to expose inner material to the infrared radiation.

2. The method of claim 1, wherein turning the hydrocarbon material comprises repositioning the chamber.

3. The method of claim 2, wherein repositioning the chamber includes raising or lowering one end of the chamber.

4. The method of claim 2, wherein repositioning the chamber includes rotating the chamber.

5. The method of claim 4, wherein the chamber has a tubular shape and rotating the chamber includes rotating the tube with respect to its longitudinal axis.

6. The method of claim 1, wherein removing air from the chamber includes evacuating atmospheric air from the chamber before heating the hydrocarbon material.

7. The method of claim 1, further comprising:

removing the gas from the chamber and collecting the gas in a storage tank.

8. The method of claim 1, further comprising:

measuring a species of gas decomposed from the hydrocarbon material by performing an infrared spectroscopic measurement; and advancing the hydrocarbon material through the chamber based on the measured species of gas.

9. The method of claim 1, wherein the infrared radiation is radiated through the transmissive wall along at least 90% of a length of the chamber.

10. An apparatus for gasification of a hydrocarbon material, the apparatus comprising:

a chamber with at least one transmissive wall that has a pass band in the infrared frequency spectrum;

an infrared emitter that is configured to radiate infrared radiation at a frequency corresponding to the pass band, the first infrared emitter being disposed outside the chamber; and a mechanical system that is configured to turn the hydrocarbon material within the chamber to expose inner material to the infrared radiation.

11. The apparatus of claim 10, further comprising a vacuum pump configured to remove gasses emitted by the heated hydrocarbon material from the chamber.

12. The apparatus of claim 10, further comprising a vacuum pump configured to evacuate atmospheric air from the chamber.

13. The apparatus of claim 10, wherein the chamber is a tube.

14. The apparatus of claim 13, wherein the at least one transmissive wall extends along at least 90% of a length of the tube.

15. The apparatus of claim 10, wherein the mechanical system is disposed outside of the chamber.

16. The apparatus of claim 15, wherein the mechanical system is configured to reposition the chamber.

17. The apparatus of claim 15, wherein the mechanical system is configured to reposition the chamber by at least one of rotating the chamber, raising an end of the chamber, or lowering an end of the chamber.

18. The apparatus of claim 10, further comprising an optical sensor configured to sense a position of the hydrocarbon material within the chamber.

19. The apparatus of claim 10, further comprising an optical sensor configured to sense at least one of a type and a concentration of gas emitted from the hydrocarbon material.

* * * * *